US006126362A

United States Patent [19]

Carter et al.

[11] Patent Number: 6,126,362

[45] Date of Patent: Oct. 3, 2000

[54] PRESSURE SECURED LIQUID DAMMING PROTECTIVE BANK DEVICE AND METHOD

[76] Inventors: Timothy L. Carter, 35 Wake Robin La., Fortuna, Calif. 95540; Daniel B. Carter, 14535 Hwy. 36, Carlotta, Calif. 95528

[21] Appl. No.: 09/260,852

[22] Filed: Mar. 1, 1999

[51] Int. Cl.[7] ..... E02B 7/08; E02B 3/06; E02B 7/02

[52] U.S. Cl. ..... 405/114; 405/16; 405/21; 405/91; 405/115

[58] Field of Search ..... 405/115, 114, 405/91, 21, 28, 29–35, 15, 16, 203, 204, 73, 270

[56] References Cited

U.S. PATENT DOCUMENTS

| | | | |
|---|---|---|---|
| 3,415,022 | 12/1968 | Schaefer et al. | 405/270 X |
| 3,965,687 | 6/1976 | Shaw . | |
| 4,184,788 | 1/1980 | Colle | 405/19 |
| 4,572,304 | 2/1986 | Mahar et al. | 175/5 |
| 4,582,451 | 4/1986 | Hollander, Jr. | 405/105 |
| 4,692,060 | 9/1987 | Jackson, III | 405/115 |
| 4,981,392 | 1/1991 | Taylor | 405/115 |
| 5,040,919 | 8/1991 | Hendrix | 405/415 |
| 5,059,065 | 10/1991 | Dooleage | 405/115 |
| 5,125,767 | 6/1992 | Dooleage | 405/115 |
| 5,173,344 | 12/1992 | Hughes | 405/115 X |
| 5,460,462 | 10/1995 | Reagan | 405/96 |
| 5,470,177 | 11/1995 | Hughes | 405/115 |
| 5,605,416 | 2/1997 | Roach | 405/21 |
| 5,820,297 | 10/1998 | Middleton | 405/114 X |

OTHER PUBLICATIONS

Book: "Tensile Structures" by Frei Otto 1962 text: p. 144 drawing: p. 145.

*Primary Examiner*—Dennis L. Taylor

[57] ABSTRACT

A protective bank damming device useful for damming and controlling the flow of a liquid, the liquid most commonly being water. The damming device barrier member is inflated with water to provide a form to the barrier member, and anchoring weight to keep the barrier secured to the substrate surface. The barrier member provides support for a skirt member extending from the top side of the barrier to a skirt distal edge abutting against the flood side substrate surface. A skirt sealing means is applied along the skirt distal edge, with the purpose of preventing leakage under the skirt and barrier member, and utilizing natural leakage inherent in this type of liquid-anchored dam, reducing the hydrostatic pressure under the skirt and barrier relative to the dammed water. This pressure differential keeps the damming device securely anchored to the surface. Other embodiments include draining means formed in the construction of the barrier, and also a means by which the barrier may be secured to a substrate surface as a suction anchored damming device. The stability of this protective bank allows water to exceed the height of the dam, and a spillway is provided to re-direct the spill to a non-eroding direction on the dry side of the dam. Other features are parallel conjoined hose-casing barrier members formed of a single casing folded back with the open ends connected, allowing water to flow from one hose-casing section to the parallel attached casing section, and the folded back ends providing a naturally flat end profile perpendicular to the surface, and a profiling means for altering the end profile.

26 Claims, 6 Drawing Sheets

PRESSURE SECURED LIQUID DAMMING PROTECTIVE BANK DEVICE AND METHOD

BACKGROUND OF THE INVENTION

This invention relates to liquid-inflated, liquid damming protective banks for damming liquids such as water, and is useful for flood control, water diversion, and the de-watering of construction sites; the protective bank being secured to the ground by adapted hydrostatic pressure of the surrounding or dammed water.

Floods are a common life threatening and property damaging occurrence, and the response to a flood is often an attempt to contain, divert or in some way control the flood water, usually by hastily constructing earthen dikes or by manually building barriers of sandbags. These methods have disadvantages.

Constructing barriers of earth requires the use of suitable heavy equipment that must be transported to the flood locale. Building earth dams with this equipment is time consuming and very expensive. Additionally, earth must be excavated, leaving scars and pits on the ground, and the dikes constructed erode easily into the flood water, thereby polluting the water and eventually failing. The sandbag method is very labor intensive and time wasting. These difficulties usually result in flood protection that is ineffective and too late, and necessitate repair of damage and removal of sandbags once the flood waters recede.

It is sometimes necessary to accomplish construction work in areas covered by water, consequently requiring the de-watering of the site. Conventional methods used to achieve this goal are to build dams using on-site soils, or installing sheet piling. Again, earth constructed check dams erode into waterways, causing the siltation of fish spawning beds and other environmental damage. Sheet piling is both labor and capital-equipment intensive. Further, such barriers are difficult to remove after the project is completed. When very large areas must be de-watered, both of these methods are impractical.

With the purpose of obviating the disadvantages associated with earth banks, sandbag protective banks, and sheet piling dams, other methods have been developed, the simplest and most efficient of which include the use of portable barriers, in the form hose-like tubes or casings which may be stored, handled, and transported in a collapsed state and filled with liquid, usually water, at the location where they are to be used. There are numerous examples of such water-filled dams disclosed in literature and patents.

The book "Tensile Structures" (1962), shows a single large hose of tough fabric which can be placed on endangered dikes. This hose is filled with water to control flooding. There is a problem with this type of design: a single tube of water that is freestanding, i.e., non-restrained, has a tendency to roll due to forces of water pressure, wave action and/or slope. A solution to the problem is a multiple tube dam. When inflated, multiple tube dams have a form that is stable. The same book shows a drawing of freestanding multiple bags. The water-filled, flexible and impermeable bags are joined in a side-by-side relationship (p144, 145). Freestanding, water or liquid-filled dams are also disclosed in U.S. Pat. No. 4,692,060, U.S. Pat. No. 4,799,821, U.S. Pat. No. 4,981,392, U.S. Pat. No. 5,040,919, U.S. Pat. No. 5,125,767, U.S. Pat. No. 5,645,373, U.S. Pat. No. 5,785,455, and U.S. Pat. No. 5,865,564.

A significant advantage of such hose casings is that they are diminutive in a deflated state, and therefore conveniently stored until they are needed, at which time they can easily be transported to the installation site. The anchoring liquid, ordinarily water, with which they are to be filled is usually abundant on-site. Consequently, a large number of these dams may quickly and efficiently be installed in place and activated by simply inflating them with the very same water they are controlling. Another advantage is that minimal site preparation is required for their successful use.

One thing that these portable damming devices have in common, is that the member of the protective bank abutting against the surface, abuts against the same over its entire area in the commendable objective of achieving the biggest possible tightness against the surface. Thus, these structures originate from the basic idea that the larger the area of contact against the surface, the more reliable becomes the sealing off of leakage under the protective bank. The above listed patents in every case use the surface abutting water-inflated barrier member(s) to prevent dammed liquid from leaking under the protective bank, although in some instances, skirts are used to assist toward this objective (see, e.g., U.S. Pat. No. 5,645,373).

Prior art teaches that freestanding, water-filled dams achieve stability because of the geometry of the dam, and they are stable against rolling so long as the level of water being controlled by the dam is not too high. As the dammed water level rises, there is a buoying force that causes the stabilizing portion of the dam to lose weight, until the dam fails by rolling, sliding, losing water underneath, or a combination of these modes of failure. These dams will fail before the height of the water dammed can reach the top of the dam. U.S. Pat. No. 4,981,392 teaches that the height of the dam must exceed the depth of water to be dammed, typically by a factor of one-third, to provide adequate vertical force to keep the structure in place in spite of the buoying force of the water contained. This portion of the dam extending above the water level, also known as freeboard, adds vertical weight, and is necessary to keep the above mentioned water-filled dams weighted to the surface.

Freeboard is essential or failure will result. Persons with experience in the art are familiar with freestanding, water-filled dam failures. Dam failure can mean the loss of an expensive dam, and the resulting flood water can cause considerable damage and put lives at risk. Also, a massive failed dam, rolling and sliding down a river, is a real danger to workers caught in its path.

U.S. Pat. No. 5,857,806 (the '806 patent) of Melin aims at obviating the above-mentioned disadvantages of the previously known protective banks. This patent teaches that the protective bank is assured a continuous anchoring ability, provided that drainage means are inserted between the surface and the member of the bank which abuts against the same, guaranteeing that the area of contact between the member and the surface is kept partially "dry" or at atmospheric pressure.

This dry area is therefore not affected by the buoying force of the dammed water. The drainage means in the '806 patent include mats and boards having channels and voids, and are attached to the barrier or are inserted between the bottom of the barrier and the surface. Although this patent demonstrates a praiseworthy advancement in the art, there are numerous problems associated with the disclosures.

Drainage mats and boards can become clogged with silt and other sediments. When this occurs, the dam of the '806 patent is affected by the same destabilizing buoyancy as the other previously listed dams. Mats and boards must be aligned perfectly to function properly, and are impossible to realign once the dam is inflated. Mats and boards would be time-wasting to install, add significant expense to the dam, and require additional storage and transportation requirements. These drainage devices would make deployment of a dam across standing or moving water difficult or impossible. Mats and boards applied as separate devices would be removed after the dam is removed, and removal might be difficult as they would likely be under water and/or embedded into substrate surface sediments. The mats and boards would be difficult to clean because the channels, voids and porosity retain dirt and contaminants. The boards are described variously as stiff and rigid, which would mean that in a case where they are fastened to the dam, the dam could not be folded or rolled, and therefor nigh impossible to handle. The mats are described as having a thickness with layers and channels, and these devices would also be difficult to roll or fold.

The '806 patent teaches that there must be a dry side toward which flood liquid leakage is drained in order to achieve near atmospheric pressure under the dam, and the resulting hydraulic, i.e., hydrostatic, pressure differential necessary for stabilizing the dam. This dam has no provisions that would allow it to function as a pressure secured dam should there be significant water levels on both sides of the dam.

Finally, the type of liquid damming protective bank as described in the '806 patent requires that two conditions be fulfilled in order for the dam to function properly: (1) a sealing means on the flood-side edge of the dam, and (2) a leakage draining means under the dam. By itself, an effective seal that stops all or most of the leakage under the dam, along with the inherent natural drainage in these liquid anchored dams, will result in the desired pressure differential and ensuing stability of the dam. But a draining means also requires a sealing means in order for the dam to perform as intended. Certainly, a draining means without a sealing means could not function as this type, or any type of dam, because the whole idea of a dam is to prevent water from flowing through or under the dam. Although the '806 patent shows an example of a sealing device, this sealing layer offers nothing novel to improve this basic function, i.e., sealing of leakage, which is a necessary requirement in a dam. U.S. Pat. No. 5,470,177 and U.S. Pat. No. 4,799, 821 describes the use of similar packing materials to prevent leakage. One thing the previously known sealing methods have in common, whether it is a seal layered beneath an anchoring barrier as described in the two patents above, or a sealing skirt, as in U.S. Pat. No. 5,645,373, is that the sealing member is brought to abut against the surface over its entire area in the praiseworthy purpose of obtaining the best possible seal. What actually happens though, is numerous points of sealing that are in a broken line, and are spread out at various places behind the flood side edge of the seal. Whether it is hydrostatic pressure forcing a skirt to the substrate surface, or the anchoring weight of a water-filled barrier, the seal will not improve and a moderate amount of leakage will flow around these scattered points of sealing. Because there is some sealing effectiveness over the entire width of the seal, from the flood side of the seal to the "dry" side of the seal, hydrostatic pressure will increase between the seal member and the substrate surface, and the seal will be buoyed up, resulting in a further decrease in sealing effectiveness.

There are other problems with the seal described in The '806 patent. The sealing means described is layered under the flood side edge of the barrier member, and therefore is inaccessible should it leak and need improvement. Also, this seal will allow increased leakage as a result of increased dammed water levels, and, like the aforementioned mats and boards under the protective bank, the applied seals have the very same disadvantages as the mats and boards in respect to installation, removal, cleaning, transportation, storage, and cost.

U.S. Pat. No. 5,460,462 and U.S. Pat. No. 4,582,451 describe seals constructed of an elastomeric, i.e., stretchable membrane, intended to the seal the periphery of flood gates, and these seals are designed to be held in position by hydrostatic pressure loading of a dammed liquid. The purpose of these seals is to stop leaks for the sake of obstructing water flow through the flood gates, with the intention of preventing water damage. The are not intended to be used for the sake of reducing hydrostatic pressure to stabilize a supporting barrier member. Also there is no mention of an edge sealing means on these membrane seals that further increases their effectiveness.

U.S. Pat. No. 4,184,788 shows devices for draining fluid from beneath an erosion control structure to equalize the hydrostatic pressure developing between the form and the surface upon which the form rests. The draining means described in this patent are applied mats of porous materials, and pipes. The above patent also teaches an embodiment with a skirt, but the skirt or apron is intended to prevent undercutting or scour of the form, and not as a sealing device.

Suction anchors making use of pump suction to induce hydrostatic differential pressure have been used to anchor pilings, storage vessels, and drilling devices to an underwater substrate surface, shown for example in U.S. Pat. No. 3,965,687 and U.S. Pat. No. 4,572,304. There is no reference made to using these suction anchors to stabilize and secure a protective bank damming device to the substrate surface.

SUMMARY OF THE INVENTION

The present invention solves the foregoing problems of the previously known protective banks and achieves technical advantages resulting in an improved protective bank. Thus, a primary object of the invention is to create a secure anchoring ability of the protective bank by improving the sealing means, thereby preventing flood water, i.e., dammed water, from leaking in under the seal and the member of the protective bank that is abutted against the surface.

A second aspect of the present invention is to provide additional stabilizing forces that utilize adapted hydrostatic pressure to pull on the barrier member in a flood side direction.

A third aspect of the present invention is to provide a spillway that prevents erosion on the dry side surface by redirecting dammed water flowing over the protective bank and down toward the surface, to a direction parallel to the surface prior to the water coming into contact with the surface.

A fourth aspect of the present invention is to provide a damming device with strong parallel barrier members that allow the flow of water from one barrier member to the other, and naturally "square" ends that are perpendicular to the surface, yet may be easily profiled to suit the needs of any particular installation.

A fifth aspect of the present invention is to provide a protective bank with good differential pressure anchoring ability by providing an axial tunnel as a draining means as part of the configuration of the basic structure of the damming device, and the elimination of applied draining devices such as mats and boards.

A sixth aspect of the present invention is to provide a strap that suspends an area on the bottom of the damming device above the surface, whereby a tunnel is created through which distributed leakage water may pass from the axial tunnel to the dry side of the dam, thus augmenting natural leakage and enhancing the anchoring ability of the protective bank, and again obviating the need for applied draining devices such as mats and boards.

A seventh aspect of the present invention is to provide a damming device capable of hyperinflation, i.e., increasing the pressure of the anchoring liquid inside the damming device, as a means of increasing the draining of leakage from the axial tunnel to the dry side of the dam, once again obviating the need for applied draining devices.

An eighth aspect of the present invention is to provide a protective bank with a suction siphon as a draining means attached to a suction port opening into the axial tunnel, whereby leakage water collecting in the tunnel may be siphoned from the tunnel and over the top of the bank.

A ninth aspect of the present invention is to provide a protective bank whereby a suction means such as a pump evacuates water from beneath the bank, and by this means keeps the protective bank securely anchored to the surface, even when the water level is high on both sides of the bank.

A tenth aspect of the present invention is to provide a method for transforming any freestanding, water-filled, water-damming barrier, including those of the previously mentioned patents, into hydrostatic pressure-secured dams by using an effective sealing skirt and allowing the water to drain from under the barrier to the dry side; and a method to further secure the same with a suction means.

This invention is based on the understanding that the protective bank is assured a continuous pressure anchoring ability, provided that the water leaking under the sealing edge of the bank is of small enough quantity. It is the nature of a protective bank damming device to leak beneath the barrier member, and this invention adds to the natural leakage through various novel features.

By use of various effective sealing devices of the flood side skirt, leakage is curtailed. By making use of and enhancing natural leakage for draining, and/or by using other means of draining found in the structure of the dam itself, and/or by using a suction means, the dam is firmly anchored to the bottom surface by the hydrostatic pressure of the dammed or surrounding water.

DESCRIPTION OF PREFERRED EMBODIMENTS

Figure 1:
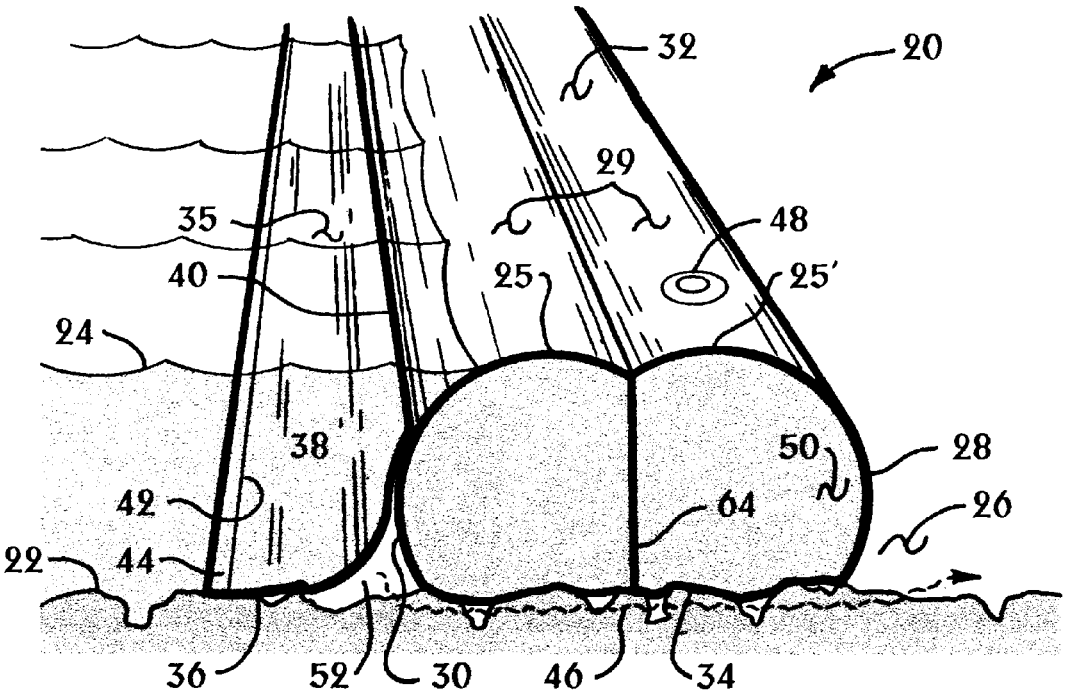
FIG. 1 is a perspective view of a flood protecting bank erected of damming devices according to the invention, more precisely in the form of hose-like casings, which are shown in a cut state in the figure.
Figure 3:
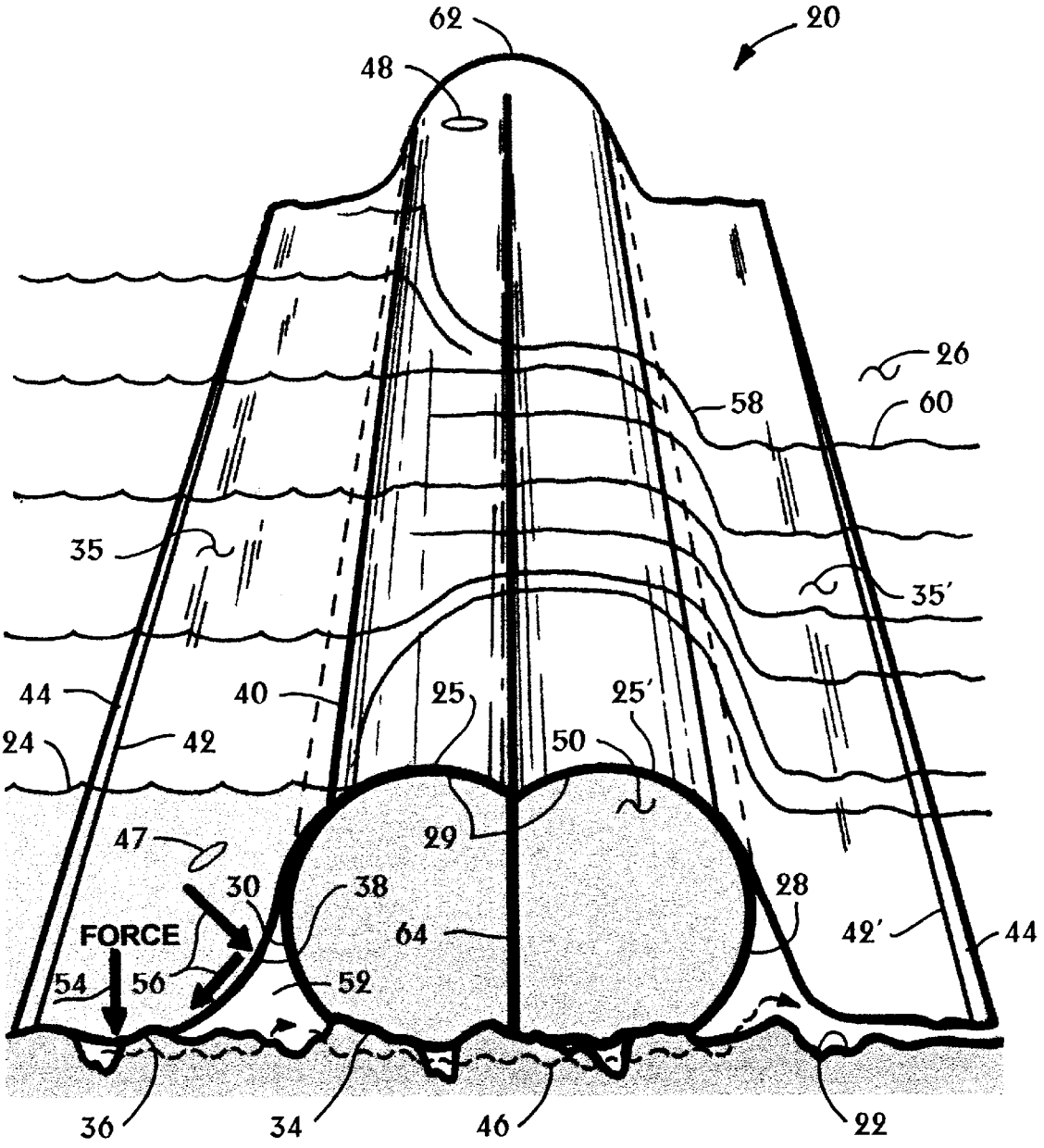
FIG. 3 is a perspective cut view of a flood protecting bank erected of damming devices according to the invention, including arrows demonstrating stabilizing hydrostatic pressure loading on the suspended skirt area, identical skirt members on each side of the bank that function as both a sealing/stabilizing skirt or a spillway depending on the orientation of the dam, a fold back end on the bank, and a flood leakage collecting and distributing axial tunnel. The dam is lower in the center and flood liquid is flowing over the dam and onto the spillway.

In FIG. 1 and FIG. 3, reference numeral 20 generally designates a damming device made according to the invention and includes hose casings, which are shown placed on a surface 22, with the purpose of controlling a mass of water or liquid 24. In practice, surface 22 usually consists of the ground at a location where flood water is to be contained. Surface 22 may also be the bottom of a waterway, i.e., the substrate surface, where an area needs to be de-watered or the water in some way must be controlled. The dry side of the ground which is found to the right of damming device 20 is designated 26.

Damming device 20 includes two different sections of hose casing 25 and 25', which are fastened securely together along their long side edges 64, by bonding or welding. The casing itself is made of impermeable fabric of the type which is commercially available under the designation geomembrane. Polyvinyl chloride coated polyester fabric is the material of choice. The two hose casings 25 and 25' after they are bonded together, constitute a barrier member section 29 with a dry side 28 and a flood, i.e., water damming, side 30. Damming device 20 is constructed of very strong fabric, and is of a design where it may be subjected to useful, very high inflation pressures, or hyperinflation, with anchoring liquid 50, which is usually water. In this hyper-inflated state, hose casings 25 and 25' assume a cross-sectional configuration very much like what is shown in FIG. 1, with the rounded sides and tops of each hose casing section forming an almost circular arc.

Damming device 20 also includes at least one filling and emptying port 48 on the top side 32 of barrier member 29. Anchoring water 50 flows through a common garden water hose or a pump discharge hose (not shown), through filling/emptying port 48, and into the interior of barrier member 29. In the preferred embodiments, as will be seen in the descriptions of other figures in the present patent, anchoring liquid may flow freely from one parallel casing section 25 to the other parallel casing section 25'. Although one port 48 will work, in practice, there should be at least two ports 48, and they should be arranged in the vicinity of the ends of barrier member 29. Filling/emptying port 48 is also used to vent air that may become trapped inside barrier member 29 during the filling process. Damming device 20 is emptied through the same filling/emptying ports 48 during the preparation of the dam for removal. In practice, the ports are, of course, provided with suitable valves or couplings which can be opened or closed.

Referring still to FIG. 1 and FIG. 3, barrier member 29 has several different functions. Flood side barrier member section 30 acts as a support and attaching surface for skirt member 35, which is fastened along the side of section 30 and above the surface 22. Barrier member 29 acts as an anchor for damming device 20 by having a mass weighted to the surface, giving rise to frictional forces that keeps damming device 20 from sliding. Barrier member 29 also has a stable geometric form that prevents damming device 20 from rolling. The portion of flood side barrier member section 30 above skirt fastening edge 40 also acts, in conjunction with skirt member 35 as a dam for controlling and/or stemming a mass of water 24.

Skirt member 35 is constructed of the same geomembrane material, and material thickness, of which barrier member 29 is made, and is partially resting 36 on surface 22 and partially suspended 38 above the surface. Skirt member 35 has first long side edge fastened 40 to the flood side of barrier member 29, above the substrate surface, and an opposed second long side skirt distal edge 42 abutting said surface, with first long side edge 40 fastening axially and for substantially the full length to the side of barrier member 29 and above the bottom of barrier member 29. Skirt member 35 extends down and away in a flood side direction from the fastening edge of skirt 40 to skirt distal edge 42. The suspended area of skirt 35 acts as a damming surface in conjunction with the upper portion of flood side barrier member 30.

Persons skilled in the art know that a fully inflated, freestanding water-filled dams will leak underneath, because the dam simply abuts against the surface, and there are usually natural pores, voids and channels under the dam that will leak. The amount of leakage depends on the type of substrate surface, the height of the water dammed, and the inflation pressure of the anchoring water inside the dam. Referring again to FIG. 1 and FIG. 3, this natural draining 46 is made use of in the present invention by draining away to the dry side 26 the small amount of dammed water 24, that may leak under skirt seal 44. It must be noted that experience has shown those skilled in the art, that water leaking through natural pores and channels beneath substrate surface 22, and then later re-emerging toward a region on the dry side of a dam, and then exerting destabilizing pressure on the bottom of the dam, is a rare and unimportant occurrence. Natural draining 46 facilitates the accomplishment of a major objective of this invention, that is, to reduce the hydrostatic pressure between bottom edge 34 of damming device 20 and the surface, to a pressure substantially less than the hydrostatic pressure at the bottom of dammed water 24. Restated, sealing against pressure in front of, while draining away pressure beneath, results in differential pressure, and the greater the differential, the better. Importantly, the hydrostatic pressure differential is adapted in a number of ways to keep dam 20 secured to the substrate surface. The other major component that is necessary for a pressure reduction under dam 20 is skirt seal 44, also shown in a close-up view in FIG. 2. In FIG. 1 and FIG. 3, is shown skirt seal 44 is fastened axially to, and for substantially the full length of skirt distal edge 42, and this seal is specially designed to form an impermeable seal to prevent flood water 24 from leaking under skirt member 35 and barrier member 29 of damming device 20. Skirt seal 44 prevents leakage from the flood side to the degree that natural draining water 46 flows at a greater rate from under damming device 20 than the amount of leakage flow under skirt seal 44.

Figure 2:
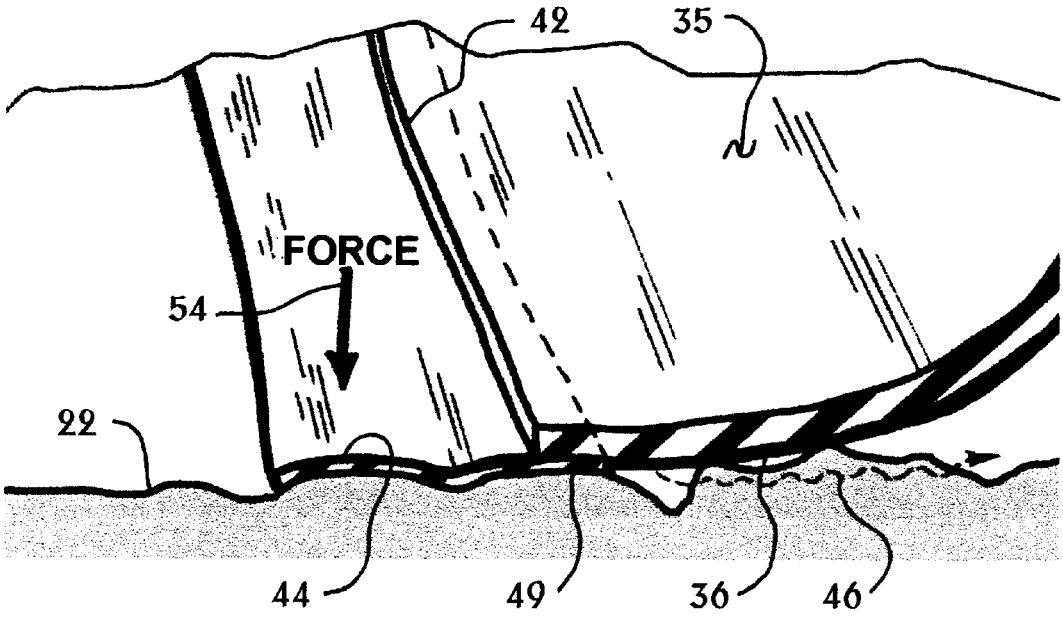
FIG. 2 is a detail cut view of the flexible, stretchable, skirt sealing membrane attached to the skirt distal edge.

As previously discussed in the background of the present invention, a wide sealing area is counterproductive to an effective seal. Accordingly, as shown in FIG. 1, FIG. 2, and FIG. 3, seal 44 is a very narrow and is fastened 49 as shown in FIG. 2, along skirt distal edge 42. Again referring to FIG. 1, FIG. 2, and FIG. 3, Seal 44 is a very flexible, stretchable, virgin, i.e., non-reinforced, membrane and is much thinner than skirt 35 to which it is fastened. The narrowness of seal 44, typically from one to six inches in width measured from a skirt distal edge 42 to the flood side edge of seal 44, assures that there is a single line of defense against leakage under skirt and dam, leaving no possibility that water can make an end run around the scattered and discontinuous points of sealing as would happen in a wide seal. As is shown in FIG. 2 and FIG. 3, the flexibility, stretchability, and thinness of seal 44, assures that it will seal much more effectively than skirt 35, and as the skirt does not seal well, it allows water to drain 46 under the skirt where it rests 36 on surface 22. The effectiveness of seal 44 increases with an increase in dammed water levels 24 because the hydrostatic pressure differential 54 forces seal 44 deeper into the natural pores, voids, and channels found on surface 22 beneath the seal.

Figure 2A:
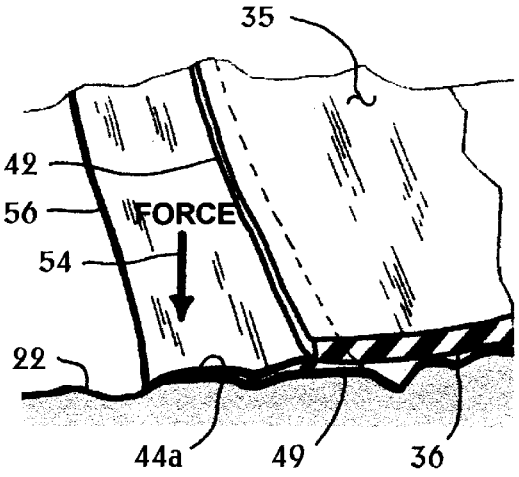
FIG. 2A is a detail cut view of the progressively thinner skirt sealing membrane attached to the skirt distal edge.

FIG. 2A shows a close-up view of the other embodiment of skirt seal 44 of FIG. 2, and has the features shown in FIG. 2. The difference is that skirt seal 44*a* shown in FIG. 2A grows progressively thinner, and therefore more pliable and stretchable, toward the flood side direction until it tapers to a flood side seal feather edge 56. This provides a further strengthened line of defense against leaking, because the actual sealing will take place on the very extreme flood side edge 56 of seal 44*a*, and the inner portion of seal 44*a* will have even greater hydrostatic pressure loading 54, than skirt seal 44, thereby forcing it deeper into the voids and channels on the surface. Other embodiments are possible, such as stepping the seal down progressively thinner toward the flood side edge, and variations such as these fall into the scope of this disclosure.

Figure 2B:
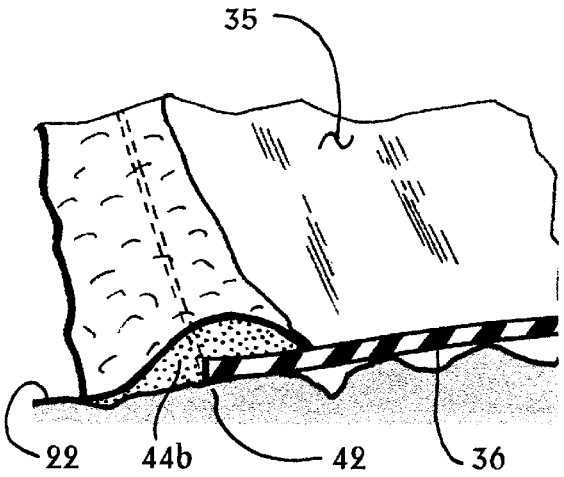
FIG. 2B is a detail cut view of the seal as an applied substance on the skirt distal edge.

In FIG. 2B, an embodiment is shown as a detail cut view of skirt member 35 resting on substrate surface 22, in which a substance 44*b* is applied to skirt distal edge 42. This substance would likely be the native soils and aggregates of the substrate surface, but could also be sealing materials such as Bentonite, sandbags, or other weighted or anchored devices. The main objective of substance 44*b* is to seal effectively enough whereby the important pressure differential previously described may be achieved. The advantage of this type of applied sealing on a skirt as opposed to the applying a seal beneath an anchored barrier member is that it can be used to improve other sealing means if necessary, and if the need should arise, improved once again at a later time. The skirt sealing edge is totally accessible.

Figure 2C:
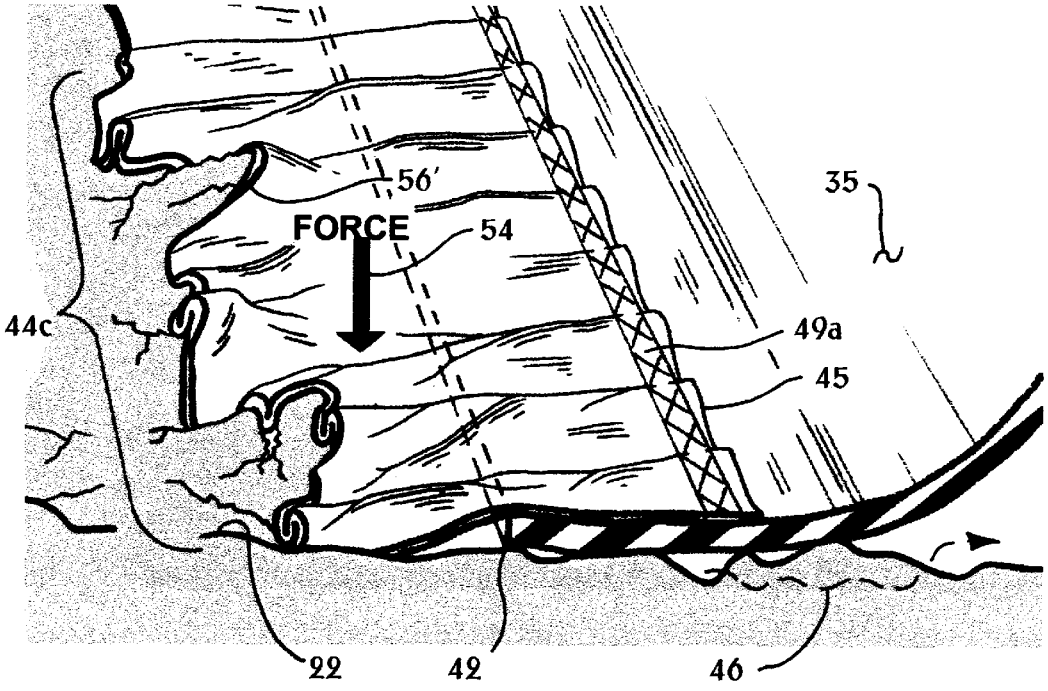
FIG. 2C is a detail cut view of the seal as an accordion folded membrane fastened to the top side of the skirt member, and extending over the skirt distal edge to abut the surface, and fanning out into and over surface irregularities.

In FIG. 2C a final sealing embodiment is shown abutting surface 22, according to which skirt sealing means 44*c* is a flexible and stretchable membrane that is accordion folded with multiple folds oriented in the direction from the flood side to the dry side. The accordion folded dry side edge is positioned on top of skirt member 35, at a distance back from skirt distal edge 42, and above the area where the skirt is partially resting on the surface, and then welded along the "dry" side ends of the folds, and over top of the pleated accordion folds 49*a*, to the top of skirt member. Flood side edge 56' of sealing membrane 44*c* extends toward the flood side direction and out beyond skirt distal edge 42, and along this accordion folded extended edge, hydrostatic differential pressure loading 54 forces the extra length of membrane provided by the accordion folds, to fan out into channels and voids on the surface, and conforms skirt sealing means 44*c* to even large unevenness of the surface compared to other sealing methods, thereby sealing pores and voids and preventing flood leakage from flowing under the skirt and barrier member. It is apparent that this sealing means can be used in various combinations with any of the other sealing means embodiments of the present invention.

The diagram in FIG. 3 shows how suspended skirt area 38 is secured on one of its suspended sides by fastening 40 to barrier member 29, and on the other suspended side by hydrostatic pressure induced friction between 35 and surface 22. Suspended area 38 is acted upon by hydrostatic pressure loading which in turn results in tensioning 56 of suspended skirt area 38. Damming device 20 is held securely to surface 22 and is stabilized in several different ways. Barrier member 29 has geometric form stability. In order for it to roll it must pick up one side off the ground and over the top of the other side. Because of the mass of anchoring liquid 50, this cannot happen. In order for barrier member 29 to slide across the ground, the destabilizing forces must be higher than the considerable friction between the bottom side of the dam and the surface. Therefore, sliding will not happen. With a skirt 35 and skirt seal 44, and the resulting high pressure differential that comes as a consequence of the sealing and draining, the stability of damming device 20 is increased many times over the stability of barrier 29 without these additions, to the extent that no freeboard is necessary. In fact, water can be dammed up to a point where it flows over the top of the dam. Even a large amount of spill will not destabilize the dam as long as the water level on the flood side 24 is significantly higher than the water level on the "dry" side 26. Skirt member 35 is anchored to the surface by hydrostatic pressure loading 54. Because the skirt is fastened to barrier 29, it restrains the barrier from rolling or sliding. Because skirt member 35 is fastened high up on the side of barrier member 29, and because suspended skirt area 38 is tensioned by resultant differential pressure forces 56, the top of the barrier is pulled toward the flood side direction, so the barrier does not need to move at all in order to achieve stability.

Again referring to FIG. 3, damming device 20 is shown with dammed water 24 spilling over the top of barrier. Severe erosion would result on most substrate surfaces by the force of the water impinging perpendicularly on the surface, and an improvement of this invention is to fasten a spillway member 35' on the "dry" side of barrier member 29, spillway 35' is shown draping down the side and curving out and away from the barrier member and resting on dry side surface 26. With this device, the flow of spill-water 58 is redirected until it is parallel 60 to the surface 26, thereby eliminating, or at least minimizing erosion.

The protective bank damming device 20 according to the invention has two opposed skirt members 35, and 35' on each side of barrier member 29. With the attachment of a skirt sealing means 44 to spillway skirt distal edge 42', both skirts are identical. These skirts are used as a dual flood side skirt member 35, and a spillway member 35', with the spillway becoming the flood side skirt and the flood side skirt becoming the spillway when dam 20 is oriented in a reverse direction.

In FIG. 1 and FIG. 3 suspended area 38 of skirt member 35 creates an axial tunnel 52, and the tunnel is defined on its three sides by suspended skirt 38, flood side 30 of barrier member 29, and substrate surface 22. Flood water leaking under skirt distal edge sealing means 44 flows into axial tunnel 52 where it is distributed the length of damming device 20 to the areas under barrier 29 that are the highest natural leakage areas. Leakage water 46 is now able to flow more freely from under the barrier to dry side 26, to obtain a maximum pressure differential under dam 20 in relation to hydrostatic pressure of the dammed water.

Figure 4:
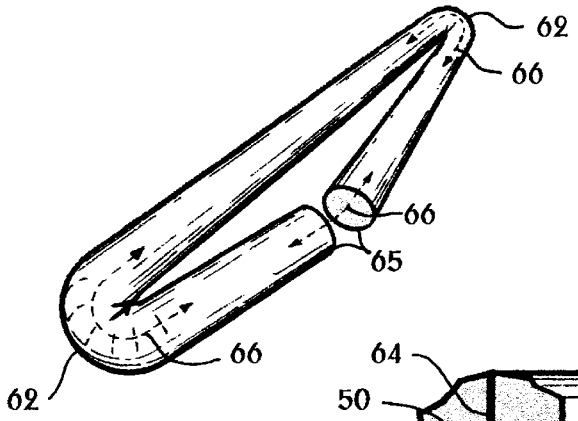
FIG. 4 is a perspective of a barrier member hose casing that has been folded back in preparation for the joining of the open ends. Also shown is the ability of liquid to flow around the folded back ends and through the junction of the open ends.
Figure 5:
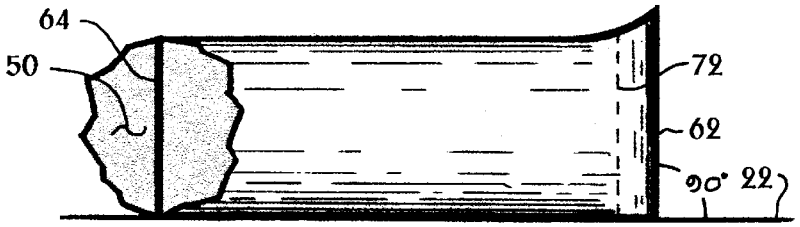
FIG. 5 is a cut side view of a folded back end of a barrier member showing the natural flatness and perpendicularity of the end relative to the substrate surface.
Figure 5A:
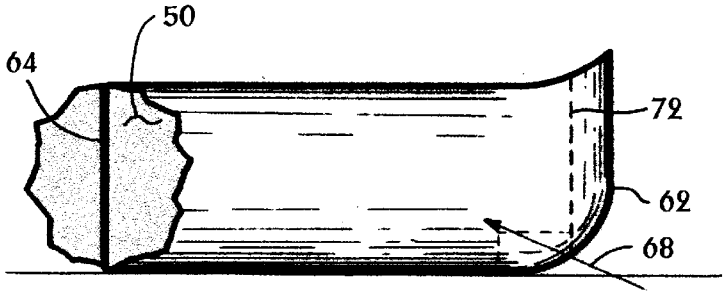
FIG. 5A is a cut side view of a folded back end of a barrier member showing the end profiling means whereby excess casing fabric is inserted between the casing sections and fastened.
Figure 10:
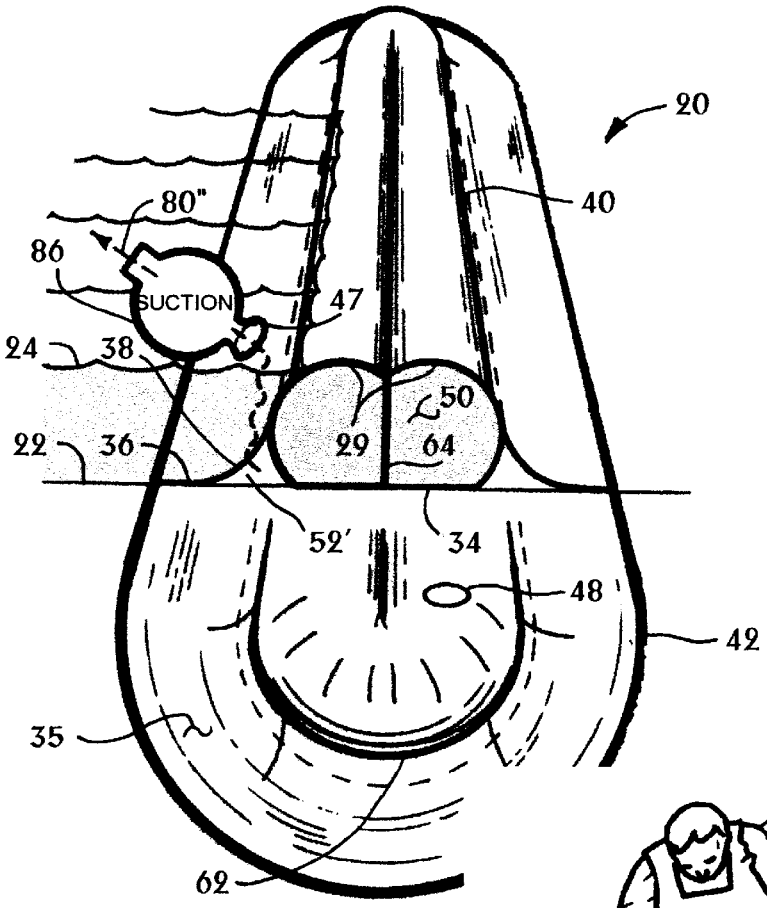
FIG. 10 is a perspective view, with a cross-section of liquid a retaining protective bank damming devices according to the invention, showing identical long side edges and identical ends, a skirt surrounding a barrier member, an annular cistern also surrounding the barrier member, for collecting and distributing flood leakage liquid, and a suction means to evacuate flood leakage liquid from the annular cistern.

In FIG. 3 and FIG. 10, damming device 20 includes parallel flexible hose casings securely bonded together along their adjoining sides 64. As shown in FIG. 4, these parallel casings are constructed out of a single length of hose casing open at each opposite end 65, and the casing is then folded back 62 in a reverse direction at a distance from each end whereby one open end is joined to the other open end in a manner whereby water may flow freely through the junction 66, and the folded back lengths of casing and the non-folded back length of casing arranged in juxtaposition and fastened along the adjoining sides. Folded back ends 62 allow anchoring water to flow freely between both parallel hose casings 66. In FIG. 5 is shown a non-obvious phenomenon that accompanies fold-back ends 62 after they are inflated with anchoring liquid 50. The end in its natural folded-back state is "flat" and perpendicular to surface 22. This can be helpful during particular dam installations, especially when abutting damming devices end to end to create longer water damming protective banks. For other particular installations, end 62 may be profiled as shown in FIG. 5A, by inserting material 68 in the center on the top or bottom of the ends, between the parallel hose casing sections prior to bonding the casing sections together. Also, shown in FIGS. 5 and 5A are bonded sides 64 of the parallel hose casing sections, and the end of bonded sides 72. Fold back ends 62, the preferred embodiment of the present invention, are also shown in FIG. 3 and FIG. 10

Figure 6:
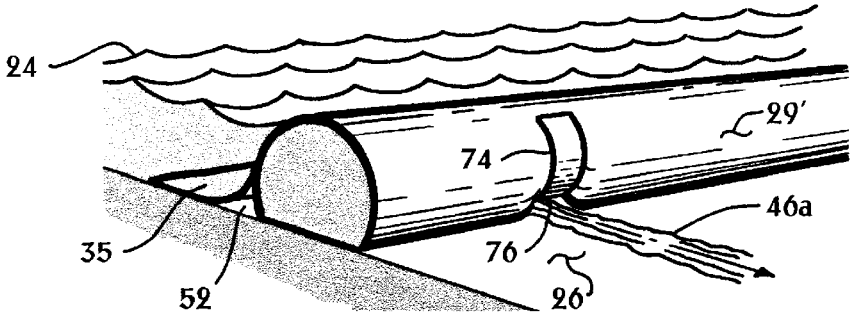
FIG. 6 is a perspective cut view of a flood damming protective bank with draining devices according to the invention, including an axial tunnel for collecting and distributing flood leakage, and a draining tunnel to drain accumulated flood leakage from the axial tunnel to the dry side of the dam.

Reference is now made to FIG. 6, a damming device of a protective bank with flood side skirt 35 damming water 24, which illustrates how a strap 74, fastened to and tensioned under barrier member 29', suspends a portion of the barrier above substrate surface 22, with the suspended area extending from axial tunnel 52 to dry side 26, thereby forming a draining tunnel 76 as a means of draining flood leakage 46*a* from axial tunnel 52 to dry side 26.

Figure 7:
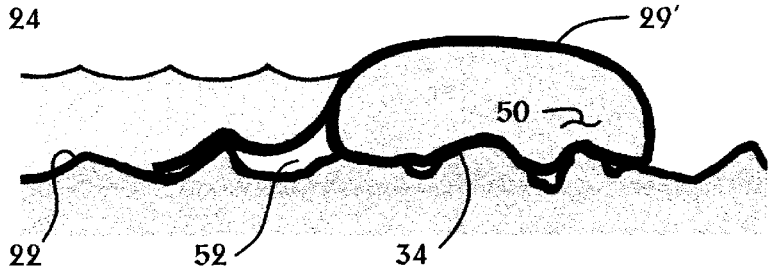
FIG. 7 is an end cut view of a damming device showing the effects of low inflation pressure of anchoring liquid on surface voids and channels.
Figure 7A:
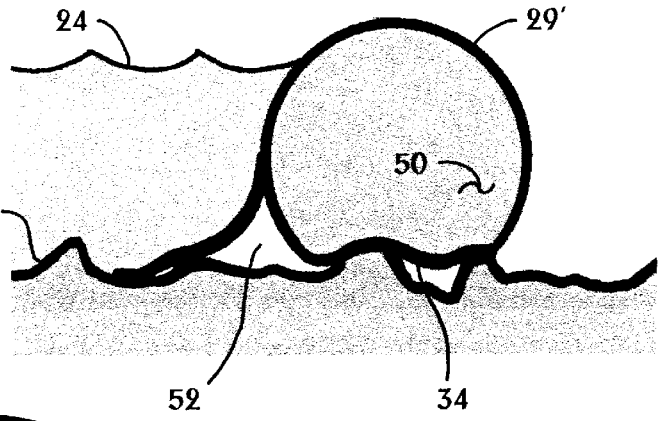
FIG. 7A is an end cut view of a damming device showing the effects of high inflation pressure, or hyperinflation, of anchoring liquid on natural flood leakage draining voids and channels.

Hyperinflation may be defined as an inflation pressure that is substantially higher than the top of the water-filled barrier member. Referring for example to FIG. 3, if a stand pipe of a length of at least several or many feet were attached vertically to filling/emptying port 48, hyper-inflated anchoring water 50 would flow up and out of the top of the pipe. Anchoring water level 50 of a normally inflated dam would be at a level with approximately the top of dam 32. Reinforced geomembrane has very high tensile strength, and a well-designed barrier member such as preferred embodiment 29 shown in FIG. 1, FIG. 3, and FIG. 10, can withstand repeated high inflation pressures and the resulting high tension imposed on the geomembrane walls. Persons with experience in the art consider hyperinflation of good use for increasing the overall size and form stability of a dam, but also view hyperinflation as having a dark side in that a hyper-inflated dam has a tendency to leak very badly underneath. With this invention, wherein sealing and draining results in a beneficial stabilizing pressure differential for the dam, the previously considered "bad" leakage of hyperinflation may be put to use as "good" drainage. FIG. 7 and FIG. 7A shows barrier members 29' with skirt 35, anchored with water 50, damming water 24. FIG. 7 illustrates an under-inflated or normally inflated barrier member 29', and FIG. 7A shows the effects of hyperinflation on barrier member 29'. There are two reasons that increased leakage (e.g., drainage) results from the hyperinflation. First, the surface area contacted by abutting barrier member 29', also known as the "footprint," decreases at the same time that hyperinflation increases, thereby shortening the distance that water must flow from axial tunnel 52 toward the dry side. Second, hyperinflation increases tension on the walls of barrier member 29', thereby pulling bottom side 34 of the barrier up out of the natural channels and voids of surface 22. Now, more water drainage will flow through these irregularities from axial tunnel 52 toward the dry side of barrier member 29'.

Figure 8:
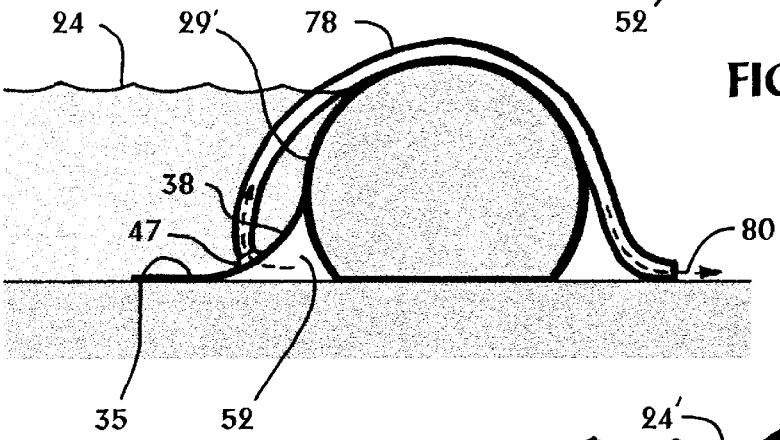
FIG. 8 is an end cut view of flood damming devices according to the invention, including a skirt for sealing, an axial tunnel for collecting and distributing flood leakage, and a siphon to drain accumulated flood leakage from the axial tunnel to the dry side of the dam.

FIG. 8 shows a particular installation of a protective bank damming device with skirt 35 damming water 24. There are circumstances that inhibit water leakage from draining away from axial tunnel 52 to the dry side of the dam, even with the use of the aforementioned draining devices and draining means of this invention, for example when the dam is installed in a thick layer of soft, impermeable sediments such as soft clay. FIG. 8 shows a means of draining the leakage water that is collected in axial tunnel 52. A suction port 47 is fastened to the suspended area 38 of the skirt member, and opens into axial tunnel 52.

Figure 9:
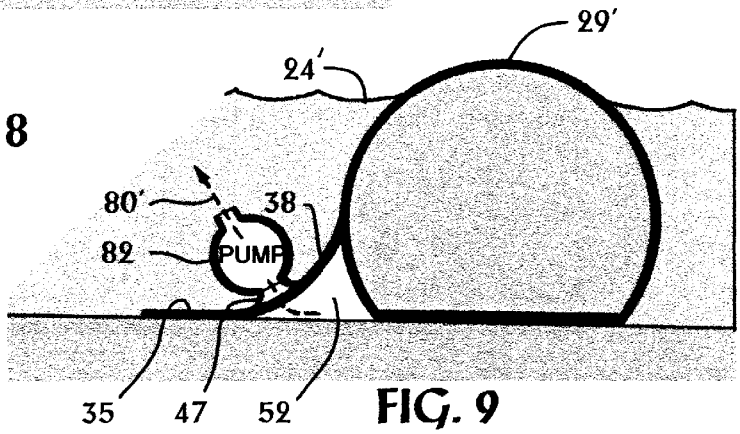
FIG. 9 is an end cut view of flood damming devices, including a skirt for sealing, an axial tunnel for collecting and distributing flood leakage, and a pump to evacuate accumulated flood leakage from the axial tunnel.

A common hose 78 is attached to suction port 47, and a siphon is started, whereby leakage liquid 80 collected in axial tunnel 52, may be siphoned from the tunnel and over the top of barrier 29' to the dry side of the protective bank. FIG. 9 shows that same damming device as shown in FIG. 8 except that in FIG. 9 the water level 24' is high on both sides of barrier 29', and there is no suction hose. Instead a pump 82 is attached to suction port 47, either directly as a submersible pump as shown, or by means of a pump suction hose. Pump 82 evacuates 80' leakage water that has collected in axial tunnel 52. The improvement in this embodiment of the present invention is that there is no need for a dry side of the dam, that is, the water level may be high on both sides of the dam, and the desirable pressure differential that secures the dam to the surface may still be achieved. FIG. 3 also shows suction port 47 attached to suspended area 38 of flood side skirt 35.

In FIG. 10, a perspective view with a cross-section, damming device 20 according to this invention has all of the features previously described in FIG. 3 except skirt distal edge sealing means 44. Skirt distal edge 42 of the damming device of FIG. 10 is the sealing means and there is no separate sealing means attached. In addition, FIG. 10 shows a skirt member 35 surrounding and fastening 40 to barrier member 29 with the skirt partially suspended above the surface, and partially resting on the surface. An annular cistern 52' is formed by and beneath suspended area 38 of the skirt, and between the skirt and the sides of barrier member 29, and therefore the annular cistern completely surrounds barrier 29. Flood water leaking under skirt distal edge 42 and toward the underside of the barrier will be collected and distributed by the annular cistern. At least one suction port 47 is mounted on suspended skirt area 38, and it opens into annular cistern 52'. A suction means 86 is attached to suction port 47, whereby suction applied to annular cistern 52', will evacuate accumulated leakage 80", so as to keep the area below bottom side 34 of damming device 20 at a substantially less hydrostatic pressure than the surrounding or dammed water. Suction devices included in this disclosure include water pumps, vacuum pumps, and siphon devices. By use of the appropriate suction device, desirable, stabilizing differential pressure may be achieved regardless of the level of the water surrounding, dammed by, or above the top of damming device 20.

A technical advantage of the invention is that it is simple and economical.

Another technical advantage are embodiments that allow deployment in either direction.

Another technical advantage is that the dam is easy to install, clean, remove, and reuse.

Another technical advantage is that any level of water may be dammed or controlled, i.e., no freeboard is necessary, yet the dam will remain securely anchored to the surface substrate.

Another technical advantage is increased damming capacity because no freeboard is required.

Another technical advantage is the safety that comes with a reliably secured dam.

Another technical advantage is a spillway for redirecting spill-water to a non-eroding direction.

Another technical advantage are folded back ends of the barrier member, and the water circulation, square ends, and profiling means that these ends provide.

Another technical advantage is the effectiveness of the skirt sealing devices and their accessibility, whereby they may be easily improved.

Another technical advantage is the draining tunnels beneath the dam are formed of the structure of the dam and are not added or applied devices.

Another technical advantage is a very strong barrier member that allows for hyperinflation and the resulting increased draining.

Other technical advantages are suction draining means, including siphons and pumps, that will not clog.

Operation

The water-filled barrier of the present invention is normally stored ready for deployment as a carefully folded and rolled package. Prior to rolling, workers lay the dam out flat, and then fold the skirt(s) back over the top of the deflated barrier. The dam is then rolled up from one end to the other, and then stored ready for use.

There are three different surface conditions commonly encountered when installing protective bank damming devices: (1) the surface is dry, (2) the surface is covered with standing water, (3) the surface is covered with moving water. The different circumstances require different techniques for success.

The time available to provide at least temporary flood protection for property may range from a few hours to several days. In this case, the water-filled dams of the present invention may be installed on dry ground in anticipation of flooding. This dry surface could be the top of a levee, or a strategic location to protect buildings, highways, or airports, for example. In this case, the rolled dam is simply oriented to the desired position, and a filling hose is attached to the fill port, and filling commences. The water may be pumped from a nearby stream, or a domestic or municipal water supply. Once the dam begins to fill, it will rapidly unroll if it is not restrained. When the dam is full, the shutoff valve of the fill port is closed and the dam is standing ready.

Often construction work must be accomplished in areas covered with water, and the work site must be de-watered. If the water is still, workers unroll the dam onto and into the water and arrange it where desired. It is sometimes advantageous to put some air into the dam if it must be floated over the water to a distant installation site. Once positioned, a filling hose is attached to the fill port, and the dam gradually sinks to the bottom until it is anchored by freeboard anchoring weight. If the dam is being used as a check dam to de-water a construction site, for example, the water is pumped out of the area that is isolated by the dam. If the water is deep, for example, up to level with the top of the fully inflated dam, it may be initially advantageous to stabilize the dam by pumping water from beneath the dam through skirt mounted suction ports 47 that are shown in FIG. 3, FIG. 9, and FIG. 10. When the dam is firmly anchored by differential pressure due to the evacuated water, the water level is lowered on one side of the dam by pumping as in the above example. When there is significant difference in the water levels on each side of the dam, and the flood side seals are contoured into place on the substrate surface, the dam will be anchored securely to the bottom by differential pressure of the two water levels. The suction pump may now be removed from the skirt mounted suction ports.

Figure 11:
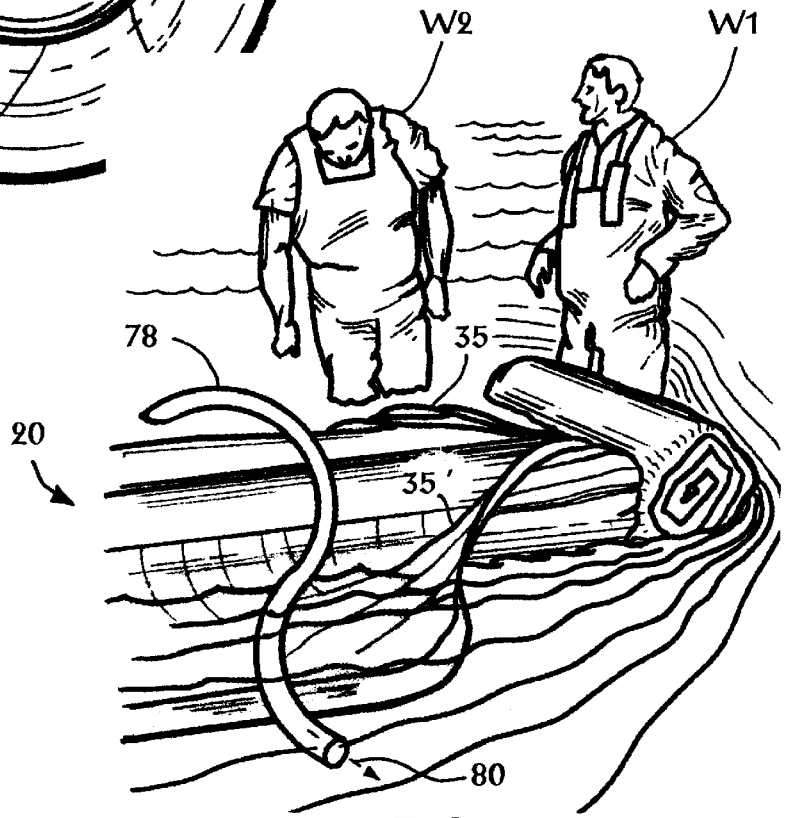
FIG. 11 is a view of a dam installation site with two workers installing a protective bank dam of the present invention.

The most challenging installation is across moving water. FIG. 11 shows two workers installing damming device 20 of this invention across moving water. Filling begins when the dam is positioned at the water's edge on one side of the waterway. A worker W1 restrains the dam from unrolling, and makes sure the dam is filled until it is above the river water level so that it will have weight enough to be stable, and not be swept away by the current. As the dam continues filling, worker W1 keeps moving back into the water, allowing the dam to further unroll. Very soon, as shown in FIG. 11, the water is high on one side and lower on the other side, and worker W2 begins unfolding flood side skirt 35 off the top of the dam and arranging it on the substrate surface. Because there is differential pressure, as is disclosed by the two different levels of water on each side of the dam, the skirt becomes effective and starts pulling and anchoring to the surface. If there is not enough natural drainage under the dam to allow a pressure reduction under the dam, siphon hose 78 may be used to evacuate accumulated leakage water 80 from the axial tunnel, also shown in FIG. 8, or a pump may be used as shown in FIG. 9.

Referring again to FIG. 11, there is one more stabilizing force that comes into play during this mode of installation. The axial tunnel beneath the flood side skirt opens near the rolled end of the dam. The swift flowing water, sweeping around the end of the dam where worker W1 is standing, has a lower hydrodynamic pressure relative to the surrounding water, and the axial tunnel opens into this moving water. This low pressure is distributed to the area beneath the dam by the axial tunnel.

Referring to FIG. 6, it can be seen that when the dam is completely unrolled, and inflated up to its full height, the straps beneath the dam tension so that a draining tunnel is formed, which allow leakage water to drain from axial tunnel 52. FIG. 7A is shows the effects of hyperinflation that can also increase leakage draining. Again in FIG. 11, spillway skirt 35' is unfolded in preparation for spill water to flow over the dam, should the dammed water level reach a level higher than the top of the dam. This can be seen in FIG. 3.

Referring again to FIG. 3 and FIG. 10, the damming devices of this invention may be abutted end-to-end with multiples of the same dam in order to extend the working length of the protective bank indefinitely. Profiling means 68 shown in FIG. 5A, applied to abutted dams as described, would leave a draining tunnel extending from the axial tunnel to the "dry" side, thereby augmenting the other draining means and devices of the present invention. The small leakage of water through the abutted skirt seals will flow freely through the end tunnels that are defined on three sides by the substrate surface, and the end-to-end edges of two abutted dams profiled as shown in FIG. 5A. A small patch of thin geomembrane material may be applied to the skirt junctions to obstruct any leakage through the skirt junctions.

Removal of the dam involves different techniques depending on the particular situation. If, for example, the flood waters recede and the dam is once again standing on dry ground, the water may be simply drained or pumped out, and the dam rolled up. If there is water still being backed up by the dam, the dam may be drained at a controlled rate, and the dammed water will flow over top of the dam. The dammed water level will lower as the dam is emptying, until the water level is equal on both sides. The dam of this invention is very stable because of differential pressure, and even when only partially inflated, it is secured to the bottom of the waterway.

The damming device according to this invention makes use of seals and draining means with the intent of reducing pressure beneath the dam. This dam gains stability to the extent that, contrary to the teachings of prior art, no freeboard is necessary, and water may in fact flow over the top of the dam while the dam remains secured to the substrate surface. The spillway skirt member of this invention is to fulfill a previously unknown need, and that need is a means of preventing erosion caused by water flowing over top of the dam to the surface on the "dry" side of the dam.

Addition of a suction device, per this invention, to a freestanding water-filled dam shows a non-obvious application of a suction anchoring principal to this type of dam, and provides an advantage that was never before appreciated, i.e., the stability of a dam to the extent, contrary to prior art's teaching, that no freeboard is necessary, and, water may in fact flow over the top of the dam, with the dam remaining secured to the surface.

Although illustrative embodiments of the invention have been shown and described, other modifications, changes, and substitutions are intended in the foregoing disclosure. For example, the damming device may be fabricated from other materials, such as nylon-reinforced or polyester-reinforced rubber, polyethylene, chlorosulfonated polyethylene, polypropylene, or other reinforced plastic or rubber. In another example, parallel barrier members with closed ends may be substituted for the folded-back ends disclosed in this invention. Accordingly, for an appreciation of the true scope and breadth of the invention, reference should be made to the following claims:

We claim:

1. A liquid-retaining protective bank having:

a. a barrier member for damming a liquid, said barrier member being adapted to abut a substrate surface in an inherently natural liquid leaking contact with said substrate surface, said barrier member constructed of a geomembrane material having a thickness; and b. a first long side edge turned toward a flood side of said protective bank, and an opposed second long side edge turned toward a dry side of said protective bank, two end edges, and a top side edge and an opposed bottom side edge, with the bottom side edge abutting said substrate surface; and c. a flood side skirt member having a first long side edge and an opposed second long side skirt distal edge abutting said substrate surface, and a top side edge and a bottom side edge, said skirt member is of the same material, and material thickness, of which said barrier members are formed, said skirt member partially suspended above said surface and partially resting on said surface, said first long side edge fastened axially to, and for substantially the full length of the flood side of the barrier member, and above the substrate surface, said skirt member extending down and away toward the flood side direction from said first long side fastening edge to said skirt distal edge; and d. a skirt sealing means applied axially to, and for substantially the full length of said flood side skirt member skirt distal edge, the improvement comprising sealing means on said skirt distal edge, said sealing means being adapted to form an impermeable seal to prevent flood liquid from leaking under the skirt and barrier, and utilizing the natural leakage inherent in this type of protective bank barrier member as draining means, and for keeping the area on the bottom side of the skirt and barrier, extending from said distal skirt edge of substantially at or about atmospheric pressure to thereby obtain a maximum pressure differential in relation to the hydrostatic pressure of the dammed liquid, said hydrostatic pressure being adapted to keep said protective bank secured to said substrate surface.

2. The protective bank according to claim 1, wherein said skirt sealing means comprises a very flexible and stretchable membrane of predetermined narrow width, with a first long side edge fastening axially to said skirt distal edge, and extending towards said flood side to an opposed second long side edge sealing against said substrate surface, said skirt sealing means of a thickness less than said thickness of said skirt member, said hydrostatic pressure differential adapted to conform said skirt sealing means to unevenness of the substrate surface, thereby sealing pores and voids and preventing flood leakage from flowing under the protective bank.

3. The protective bank according to claim 2, wherein said membrane is progressively thinner toward the flood side direction.

4. The protective bank according to claim 1, said skirt sealing means having a flexible and stretchable membrane with a first long side edge turned toward the dry side, and an opposed second long side edge, said skirt sealing means is accordion folded with multiple folds extending from the first long side to the second long side of the skirt sealing means; and a. said first long side edge of said accordion-folded sealing means is positioned axially on the top side edge of the skirt member at a distance back from said skirt distal edge, but still in the area where said skirt member is partially resting on said substrate surface; and b. said skirt sealing means first long side edge is welded to said top side edge of the skirt member, the weld being over top of the ends of the pleated accordion folds; and c. said second long side accordion-folded edge extending out toward said flood side direction and beyond said skirt distal edge, and abutting said substrate surface, and the hydrostatic pressure differential is adapted to fan out the extra length of membrane, provided by the accordion folds, into channels and voids on said substrate surface, and conform said skirt sealing means to even a large unevenness of the surface, thereby sealing natural channels, pores, and voids, and preventing flood leakage from flowing under said protective bank.

5. The protective bank according to claim 1, wherein said skirt sealing means comprises an applied substance, said applied substance sealing pores and voids and preventing flood leakage from flowing under said protective bank.

6. The protective bank according to claim 1, wherein said suspended area has a first long side edge and an opposed second long side edge, said first long side edge is fastened axially to, and for substantially the full length of the flood side of the barrier member, and said second long side edge of said suspended area is secured to the substrate surface by hydrostatic pressure induced friction between the skirt member and the surface; in addition, said suspended area being acted upon by adapted hydrostatic pressure, resulting in tensioning of the suspended area, and distinctly claiming the barrier member is pulled toward the flood side direction, and toward the substrate surface, thereby further securing and stabilizing the protective bank.

7. The protective bank according to claim 1, further including said dammed liquid at a level higher than said top side edge of said barrier member; and a. a spillway skirt member having a first long side edge and an opposed second long side skirt distal edge resting on said substrate surface, and a top side edge and a bottom side edge, said spillway skirt member of the same material, and material thickness, of which said barrier members are formed; and b. said spillway skirt member is partially suspended above said surface and partially resting on the surface, said first long side edge fastened axially to, and for substantially the full length of the dry side of the barrier member, and above the substrate surface, with the skirt member extending down and away towards the dry side direction from its first long side fastening edge, to the skirt distal edge; and c. said flood liquid flowing towards the dry side direction and over the top of the barrier member and onto said spillway member, thence down and away towards the surface, thence parallel to the dry side substrate surface prior to the liquid coming in contact with the surface, distinctly claiming spillway skirt member redirecting flood liquid and preventing erosion of the dry side substrate surface.

8. The protective bank according to claim 7, further including a spillway skirt member skirt sealing means applied axially to, and for substantially the full length of the spillway skirt member skirt distal edge, wherein, with the addition of said spillway skirt member skirt sealing means, the flood side skirt member and the spillway skirt member are identical skirt members, either of which skirt members may be turned towards the flood side direction, whereby the spillway skirt member becomes the flood side skirt member, and the flood side skirt member becomes the spillway skirt member, distinctly claiming as an improvement the reversibility of the protective bank.

9. In a damming device for erecting a protective bank according to claim 1, in which said barrier member comprises at least two elongate, parallel casings having a means for filling and emptying an anchoring liquid therein and therefrom, the improvement wherein the casings have, along their length, at least two different conjoined sections formed of a single casing open at each opposite end, said single casing folded back in a reverse direction at a distance from each end whereby one open end is joined to the other open end, and the folded back lengths of casing and the non-folded back length of casing arranged in juxtaposition and fastened securely along their adjoining sides and filled with anchoring liquid to complete the parallel and conjoined sections, particularly pointing out the folded back ends permitting the anchoring liquid to flow between the sections; and at least one parallel casing including a flood side skirt member and a flood side skirt sealing means to prevent flood liquid from entering the area beneath the protective bank.

10. The damming device according to claim 9, wherein the improvement is the folded back ends comprising an inherently vertical, straight profile of the end in a perpendicular relationship with the substrate surface.

11. The damming device according to claim 9, wherein said folded back ends comprise an end profiling means, whereby excess casing material on the top and bottom of the ends, said excess casing material having been created by the fold, may be inserted between the parallel sections and bonded to meet end profile requirements necessary for a particular installation.

12. A liquid-retaining protective bank having:

a. a barrier member for damming a liquid, said barrier member being adapted to abut a substrate surface in an inherently natural liquid leaking contact with the substrate surface, said barrier member constructed of a geomembrane material having a thickness; and b. a first long side edge turned towards a flood side of said protective bank, and an opposed second long side edge turned towards a dry side of the bank, and two end edges, and a top side edge and an opposed bottom side edge, with said bottom side edge abutting the substrate surface; and c. a flood side skirt member having a first long side edge and an opposed second long side skirt distal edge abutting the substrate surface, and a top side edge and a bottom side edge, and the skirt member is of the same material, and material thickness, of which said barrier members are formed, and the skirt member partially suspended above the surface and partially resting on the surface, said first long side edge fastened axially to, and for substantially the full length of the flood side of the barrier member, and above the substrate surface, said skirt member extending down and away towards the said flood side direction from said first long side fastening edge to said skirt distal edge; and d. said flood side skirt member partially suspended area has a first long side edge and an opposed second long side edge, said first long side edge is fastened axially to, and for substantially the full length of the flood side of the barrier member, and said second long side edge of said suspended area is secured to the surface by hydrostatic pressure induced friction between the skirt member and the surface; and e. an axial tunnel formed beneath said suspended area of said skirt member and extending the full length of said barrier member, said axial tunnel defined on its three sides by the surface, the flood side of the barrier member, and the bottom side of the suspended skirt, whereby flood liquid leaking under said skirt distal edge sealing means may be collected and distributed, the improvement comprising said axial tunnel distributing flood leakage liquid axially to the highest natural leakage areas inherent to said liquid-retaining protective bank as draining means, and for keeping the area on the bottom side of the protective bank, extending from the axial tunnel of substantially at or about atmospheric pressure to thereby obtain a maximum pressure differential in relation to the hydrostatic pressure of the dammed liquid, said hydrostatic pressure being adapted to keep the bank secured to the substrate surface.

13. The protective bank according to claim 12, wherein said suspended skirt area is also being acted upon by adapted hydrostatic pressure, resulting in tensioning of the suspended area, and distinctly claiming the barrier member is pulled toward the flood side direction, and toward the substrate surface, thereby further securing and stabilizing the protective bank.

14. The protective bank according to claim 12, further including at least one strap comprising a first long side edge and an opposed second long side edge, and a first end edge fastened towards the top side and on the flood side of the barrier member, and a second end edge fastened to the dry side and towards the top side of the barrier member, and the strap is in a tensioned state under the bottom side edge of the barrier member, whereby an area on the bottom of the barrier, extending between said flood side axial tunnel to the dry side of the barrier, is supported by the strap, distinctly claiming the strap is holding and suspending a portion of the protective bank above the substrate surface and forming a draining tunnel as a draining means, through which leakage liquid may pass from the axial tunnel to the dry side of the barrier, said draining tunnel adding to said inherent natural draining means.

15. The protective bank according to claim 12, further including hyperinflation as a draining means, whereby adding more anchoring liquid to said barrier member increases tension of the bottom of the barrier, thereby increasing the size of the natural voids and channels on the uneven substrate surface beneath the barrier; said hyperinflation also decreasing the distance flood leakage liquid must travel from the flood side to the dry side of the barrier, resulting in increased draining of flood leakage from the axial tunnel to the dry side of the protective bank.

16. The protective bank according to claim 12, further including dammed liquid that is higher than the top side of the barrier member, and a spillway skirt member having a first long side edge and an opposed second long side skirt distal edge resting on said substrate surface, and a top side edge and a bottom side edge, the spillway skirt member being of the same material, and material thickness, of which said barrier members are formed, said spillway skirt member partially suspended above the substrate surface and partially resting on the surface, and the first long side edge fastened axially to, and for substantially the full length of the dry side of the barrier member, and above the substrate surface, said skirt member extending down and away towards the dry side direction from the first long side fastening edge to said skirt distal edge; said flood liquid flowing towards the dry side direction and over the top of the barrier and onto the spillway, thence down and away towards the surface, thence parallel to the dry side substrate surface prior to the liquid coming in contact with the surface, distinctly claiming as an improvement spillway skirt member redirecting flood liquid and preventing erosion of the dry side substrate surface.

17. The protective bank according to claim 16, wherein said flood side skirt member and said spillway skirt member are identical skirt members, either of which skirt members may be turned towards the flood side direction, whereby the spillway skirt member becomes the flood side skirt member, and the flood side skirt member becomes the spillway skirt member, distinctly claiming reversibility of the protective bank.

18. The protective bank according to claim 12, further including mounting at least one suction port on said suspended area of said flood side skirt member, said suction port opening into to said axial tunnel.

19. The protective bank according to claim 18, further including a suction siphon as draining means, said suction siphon attached to said suction port, whereby leakage liquid collecting in said axial tunnel may be siphoned from the axial tunnel and over the top of the barrier to the dry side of the protective bank.

20. In a damming device for erecting a protective bank according to claim 12, in which said barrier member comprises a flexible elongate casing having means for filling and emptying an anchoring liquid therein and therefrom, the improvement wherein said casing has, along its length, at least two different parallel and conjoined sections, formed of a single casing open at each opposite end, and the casing folded back in a reverse direction at a distance from each end whereby one open end is joined to the other open end, and the folded back lengths of casing and the non-folded back length of casing arranged in juxtaposition and securely fastened along the adjoining sides and filled with said liquid to complete said parallel and conjoined sections, particularly pointing out said folded back ends permitting said anchoring liquid flow between said sections; and at least one parallel casing including a flood side skirt member, and an axial tunnel as a draining means to keep the area under the bottom side of the protective bank at or about atmospheric pressure.

21. In a method for forming a pressure secured liquid-retaining protective bank having:

a. barrier member for damming a liquid, said barrier abutting against a substrate surface in an inherently natural liquid leaking contact with the surface; and b. a first long side edge turned towards a flood side of said protective bank, and an opposed second long side edge turned towards a dry side of said protective bank, and a top side edge and an opposed bottom side edge, with the bottom side edge abutting the substrate surface; and c. a flood side skirt member having a first long side edge and an opposed second long side skirt distal edge sealing means abutting said substrate surface, and applying said flood side skirt member to the flood side of, and towards the top side of said barrier members, said first long side edge of said skirt member applied axially to, and for substantially the full length of said barrier member, said skirt member extending down and away in said flood side direction from said barrier member to said skirt distal edge sealing means, the improvement comprising skirt distal edge sealing means, said sealing means being adapted to form an impermeable seal to prevent flood liquid from leaking under the skirt and barrier, and utilizing said natural leakage inherent in said liquid-retaining protective bank barrier member as draining means, and for keeping the area on the bottom side of the skirt and barrier, extending from said distal skirt edge of substantially at or about atmospheric pressure to thereby obtain a maximum pressure differential in relation to the hydrostatic pressure of said dammed liquid, said hydrostatic pressure being adapted to keep said protective bank secured to said substrate surface.

22. The method according to claim 21, including a suction means as supplementing natural leakage draining, the improvement comprising said suction means evacuating liquid from under the protective bank, thereby providing a low pressure layer beneath the protective bank, and keeping the bank secured to the substrate surface.

23. A liquid-retaining protective bank having:

a. a barrier member for damming a liquid, said barrier member being adapted to abut a substrate surface; and b. two identical and opposed long side edges, either of which edges may be turned towards a flood side of said protective bank, and two identical and opposed ends, and a top side edge and an opposed bottom side edge, with the bottom side edge abutting the substrate surface; and c. a skirt member surrounding and fastening to said barrier member, said skirt member partially suspended above said substrate surface, and partially resting on and securing to the substrate surface by adapted hydrostatic pressure, said skirt member having:

1. an inside skirt edge fastening circumferentially to the barrier sides and ends above the bottom of the barrier, said skirt member extending down and away from the fastening edge to a skirt distal edge sealing means abutting the substrate surface; and 2. said suspended area of said skirt member is proximate the side of said barrier, said area suspended on one end from the barrier, and on the other end by hydrostatic pressure induced friction between the skirt member and the surface; and d. an annular cistern formed above the surface and beneath said suspended area, and between the skirt and the barrier member, whereby flood liquid leaking under the skirt distal edge sealing means may be distributed and collected; and e. at least one suction port mounted on the suspended area of the skirt member, said suction port opening into said annular cistern; and distinctly claiming the improvement comprising applying a suction means to the annular cistern, and evacuating accumulated flood leakage, so as to keep the area on the bottom side of the bank, extending inward from said surrounding skirt distal edge sealing means, of substantially less hydrostatic pressure relative to the dammed liquid, said hydrostatic pressure being adapted to keep the protective bank secured to the substrate surface.

24. The protective bank according to claim 22, wherein said suction means comprises a pump means, distinctly claiming keeping the area on the bottom side of the bank at substantially less hydraulic pressure relative to the liquid on either side of the bank, thereby securing the protective bank to the substrate surface by adapted hydrostatic pressure even when the liquid level is higher than the top side of the protective bank.

25. The protective bank according to claim 22, wherein said suction means comprises a siphon means, whereby leakage liquid collecting in said annular cistern may be siphoned from said cistern and over the top and away from said flood side of said protective bank.

26. In a damming device for erecting a protective bank according to claim 22, in which said barrier member comprises at least two elongate, parallel casings having a means for filling and emptying an anchoring liquid therein and therefrom, the improvement wherein the casings have, along their length, at least two different conjoined sections formed of a single casing open at each opposite end, said single casing folded back in a reverse direction at a distance from each end whereby one open end is joined to the other open end, and the folded back lengths of casing and the non-folded back length of casing arranged in juxtaposition and fastened securely along the adjoining sides and filled with anchoring liquid to complete the parallel and conjoined sections, particularly pointing out the folded back ends permitting the anchoring liquid to flow between the sections; said parallel casings including a surrounding skirt member and a skirt sealing means to prevent flood liquid from entering the area beneath the protective bank.

* * * * *